US007616921B2

(12) United States Patent
Shida et al.

(10) Patent No.: US 7,616,921 B2
(45) Date of Patent: Nov. 10, 2009

(54) SHEET COOLING DEVICE, INTERMEDIATE SHEET CONVEYING DEVICE AND IMAGE FORMING APPARATUS HAVING THE SAME

(75) Inventors: Toshio Shida, Higashiyamato (JP); Masaaki Uchiyama, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 142 days.

(21) Appl. No.: 11/501,290

(22) Filed: Aug. 9, 2006

(65) Prior Publication Data

US 2007/0098470 A1 May 3, 2007

(30) Foreign Application Priority Data

Nov. 2, 2005 (JP) ..... 2005-319388

(51) Int. Cl.
*G03G 15/00* (2006.01)

(52) U.S. Cl. ..... 399/341; 399/405; 399/92; 271/202; 271/303

(58) Field of Classification Search ..... 399/341, 399/405, 381–411, 92; 271/303, 202
See application file for complete search history.

(56) References Cited

U.S. PATENT DOCUMENTS 5,461,468 A * 10/1995 Dempsey et al. ..... 399/396
5,598,258 A * 1/1997 Sato et al.
5,689,795 A * 11/1997 Mastrandrea ..... 399/407
6,226,474 B1 5/2001 Kowalski et al.
6,259,871 B1 * 7/2001 Rider et al. ..... 399/92
6,259,888 B1 7/2001 Kazama et al.
2004/0067082 A1 * 4/2004 Uehara et al. ..... 399/341
2005/0238399 A1 10/2005 Moteki et al.
2006/0285900 A1 * 12/2006 Kurita

FOREIGN PATENT DOCUMENTS

JP 01053955 A * 3/1989
JP 01 172981 A 7/1989
JP 06 312848 A 11/1994
JP 09 227019 A 9/1997
JP 10 104890 A 4/1998
JP 10-254285 A 9/1998
JP 2004 145160 A 5/2004
JP 2004-198863 A 7/2004

* cited by examiner

*Primary Examiner*—David M Gray
*Assistant Examiner*—G. M. Hyder
(74) *Attorney, Agent, or Firm*—Frishauf, Holtz, Goodman & Chick, P.C.

(57) ABSTRACT

A sheet conveying mechanism, which conveys a sheet on which a toner image has been fixed at a heat-fixing process, includes conveying rollers each of which is a single roller having the same diameter throughout a width for passing the sheet and is disposed in a predetermined section for a cooling process after the heat-fixing process, and includes a sheet conveying guide provided on the predetermined section and having a sheet-passing surface made in the same shape throughout the width for passing the sheet.

4 Claims, 2 Drawing Sheets

SHEET COOLING DEVICE, INTERMEDIATE SHEET CONVEYING DEVICE AND IMAGE FORMING APPARATUS HAVING THE SAME

This application is based on Japanese Patent Applications No. 2005-319388 filed on Nov. 2, 2005 in Japan Patent Office, the entire content of which is hereby incorporated by reference.

FIELD OF THE INVENTION

The present invention relates to a sheet conveying mechanism that conveys a sheet on which a toner image has been heat-fixed, while cooling it, an intermediate sheet conveying device provided with the sheet conveying mechanism, and an image forming apparatus provided with the intermediate sheet conveying device.

BACKGROUND OF THE INVENTION

With an image forming apparatus that forms an image by an electro-photographic method, in general, an image is formed of a toner of fine particles on a sheet; the toner on the sheet is melt by heat-pressing in a fixing device to be fixed as a toner image; and the sheet is ejected or transported to a post-processing device.

In recent years, high speed printing has been enabled, and a sheet is transported to a post-processing device for binding processing before the sheet on which an image having been fixed is not cooled sufficiently, which causes a problem of generating uneven glossiness (uneven waxing) of a toner image in the process where the sheet passes through the conveying path in the post-processing device, when, for example, the sheet is pinched by conveying rollers.

To avoid this problem, the following methods are disclosed.

1) A method that passes a sheet through sheet-cooling rollers which are formed of heat-pipes, at a lower conveying speed than that during the time the sheet passes through a fixing device, and thereby lowers the temperature (refer to Unexamined Japanese Patent Application Publication No. H10-254285, for example).

2) A method that cools a sheet fed out from a fixing device in the main body of an image forming apparatus, while a belt cooled by a cooling fan sucks and conveys the sheet (refer to Unexamined Japanese Patent Application Publication No. 2004-198863, for example).

However, since cooling means is arranged in the main body of an image forming apparatus and it is necessary to secure a conveying space to be used after a fixing process, these methods have shortcomings of a larger size of the apparatus main body and an increase in cost due to a cooling fan, heat roller, conveying belt, sucking unit, etc.

SUMMARY OF THE INVENTION

The invention includes the following structures.

Structure 1.

A sheet conveying mechanism that conveys a sheet on which a toner image has been fixed at a heat-fixing process, the mechanism including:

conveying rollers each of which is a single roller having the same diameter throughout a width for passing the sheet and is disposed in a predetermined section for a cooling process after the heat-fixing process; and a sheet conveying guide provided on the predetermined section and having a sheet-passing surface made in the same shape throughout the width for passing the sheet.

Structure 2.

An intermediate sheet conveying device that receives a sheet on which a toner image has been heat-fixed by a heat-fixing unit of an image forming apparatus main body, and delivers the sheet to a subsequent post-processing device, the device including:

conveying rollers each of which is a single roller having the same diameter throughout a width for passing a sheet and is disposed at least in a predetermined section which is on a receiving side for receiving a sheet from the image forming apparatus main body; and a sheet conveying guide that has, in the predetermined section, a sheet-passing surface of the same shape throughout the width for passing a sheet.

Structure 3.

An image forming apparatus, including:

an image forming apparatus main body that forms an image on a sheet;

the intermediate sheet conveying device of above Structure 2 that receives a sheet from the image forming apparatus main body; and a post-processing device that receives a sheet from the intermediate sheet conveying device and performs post-processing on the sheet.

DESCRIPTION OF THE PREFERRED EMBODIMENT

Figure 1:
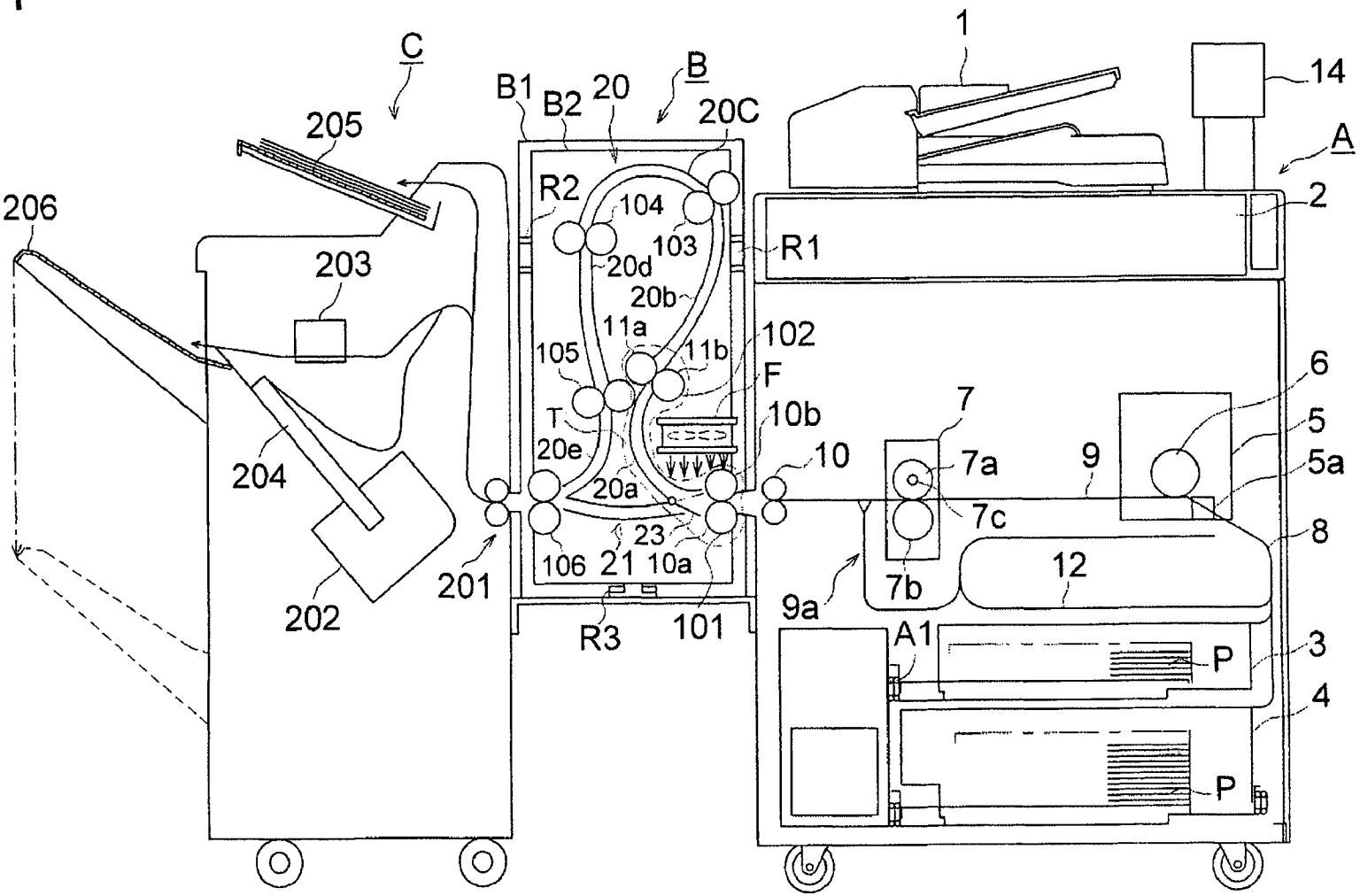
FIG. 1 is an entire view of an image forming apparatus in an embodiment in accordance with the present invention.

FIG. 1 is an entire view of an image forming apparatus in an embodiment in accordance with the invention. The image forming apparatus includes an image forming apparatus main body A, intermediate sheet conveying device B, and post-processing device C.

The image forming apparatus main body A has an automatic original document sheet conveying device 1 and image reading device 2 at the upper part, and a printer unit at the lower part.

The printer unit includes sheet storing units 3 and 4 that store sheets P. An image forming unit 5 having a photoreceptor 6 forms a toner image on the photoreceptor 6 through an electro-photographic process that performs charging, exposing, and developing on the photoreceptor 6. In the image forming unit 5, an image is formed on a sheet P, and the formed image is fixed by a fixing device 7. The fixing device 7 forms a nip section with a heat-roller 7*a* having a built-in heat source 7*c* and press-roller 7*b* to convey the sheet P. While the sheet is conveyed, the sheet is heated and pressed so that the toner is melt and the image is fixed to the sheet P.

A sheet P is supplied from the sheet storing unit 3 or 4, temporarily stopped at a feeding unit 5*a* of the image forming unit 5, thereafter fed from the feeding unit 5*a* so as to be formed with an image, and the sheet P formed with the image is ejected from ejection rollers 10.

As sheet conveying paths, there are provided a sheet feeding path 8 from the sheet storing units 3 and 4 to the image forming unit 5, a conveying path 9 from the image forming unit 5 through the fixing device 7 to ejection rollers 10, and a back-side conveying path 12 for reverse conveying.

As image forming modes, a single-face-down sheet ejection mode, single-face-up sheet ejection mode, and double sided mode are arranged. In the single-face-down sheet ejection mode, an image is formed on a single side, and a sheet P having passed through the fixing device 7 is front-back reversed by a switchback conveying path 9*a*, and thereafter conveyed by the ejection rollers 10 to be ejected.

In the single-face-up sheet ejection mode, an image is formed on a single side, and a sheet P having been conveyed through the conveying path 9 is conveyed by the sheet ejection rollers 10, without being reversed, to be ejected.

In the double sided mode, an image is formed on a single side. A sheet P having passed through the fixing device 7 is conveyed down to the back-side conveying path 12, front-back reversed, and then again fed to the sheet feeding path 8.

In the image forming unit 5, a back-side image is formed on the back side of the sheet P having been fed again, and the sheet P formed with the back-side image is passed through the fixing device 7 and conveyed by the sheet ejection rollers 10 to be ejected.

An operation unit 14 enables selection from various modes in the image forming apparatus main body A and output modes (a conveying path, sheet ejection tray, staple, etc.) which use a post-processing device C, and enables switching between the first and second conveying paths in the intermediate sheet conveying device.

The sheet P having been ejected from the image forming apparatus main body A is conveyed through the intermediate sheet conveying device B to the post-processing device C. The intermediate sheet conveying device B will be described later.

The post-processing device C includes a staple processing unit 202, a shift processing unit 203, and an intermediate stacker 204. The post-processing device C performs stapling or shifting of sheets and ejects them to a rising-and-falling sheet ejection tray 206.

The post-processing device C further includes a fixed sheet ejection tray 205, and a sheet P having entered from an entrance opening 201 is ejected to the fixed sheet ejection tray 205 in an image forming job for a small amount.

For the stapling process, a set number of sheets are stacked on an intermediate stacker 204, then the sheets are stapled by the staple processing unit 202, and the bundle of sheets P having been processed rises along the stacker 204 to be ejected to the rising-and-falling tray 206.

Even in a mode which does not perform post-processing, such as staple processing and shift processing, for a small amount, sheets P are ejected onto the rising-and-falling tray 206 in the case of image forming in a large amount.

A control unit A1, which is a control device, performs image forming process control, fixing temperature control, sheet conveying sequence control of the entire apparatus, and the like.

The intermediate sheet conveying device B having a sheet conveying mechanism in accordance with the invention will be described below.

As shown in FIG. 1, the intermediate sheet conveying device B is disposed between the image forming apparatus main body (hereinafter, also referred to merely as the main body) A and the post-processing device C, and has functions to receive a heated sheet from the image forming apparatus main body A, cool the sheet down to a predetermined temperature or lower while conveying the sheet in a predetermined section of a conveying path, and deliver the sheet to the post-processing device C.

The intermediate sheet conveying device B includes an outer frame body B1, a conveying unit B2 that contains sheet conveying paths, and the like. The conveying unit B2 can be taken out from and put into the outer frame B1 through drawout guide rails R1, R2 and R3, and is fixed inside the outer frame B1 by a locking mechanism, not shown, during operation.

The conveying unit B2 includes a first conveying path 20 that delivers a sheet to the pos-processing device, having the sheets bypass in order to prevent occurrence of uneven glossiness.

That is, uneven glossiness tends to occur on some sheets and does not tend to occur on other sheets, depending on the quality and the amount of sheets. Particularly, it is predictable that uneven glossiness tends to occur if machine coated paper is used, and in a case of performing a large amount of printing, if the operator, for example, sets 'normal mode' to pass sheets through the second conveying path 21 via the operation unit 14 at first, then the intermediate conveying device B is interlocked with the control unit A1, and the sheet passing valve 23 as a switching gate of the conveying path at a branch section turns into the state shown by the dashed line. The operator makes trial printing for one or a couple of sheets in this state, ejects the sheets onto the fixed sheet ejection tray 205 of the post-processing device C, and confirms whether uneven glossiness has occurred or not. With a result, the operator selects 'uneven glossiness prevention mode' via the operation unit 14 to make a switch for using the first conveying path in the case of 'occurrence of uneven glossiness', or continues to use the second conveying path without a change in the case of 'occurrence of no uneven glossiness'. However, in a case where it is predictable that uneven glossiness tends to occur as in the case of machine coated paper, the operator can select 'uneven glossiness prevention mode' at first via the control unit 14. Further, it is also possible to arrange a sensor for detection of the amount of sheets on the upstream side of the sheet ejecting rollers 10 so that the sheet passing valve 23 automatically turns into the state shown by the dashed line in a case of sheets on which uneven glossiness tends to occur. Further, it is also possible to provide a function to determine automatic switching, according to the type of paper (for example, machine coated paper) selected via the operation unit 14.

Figure 2:
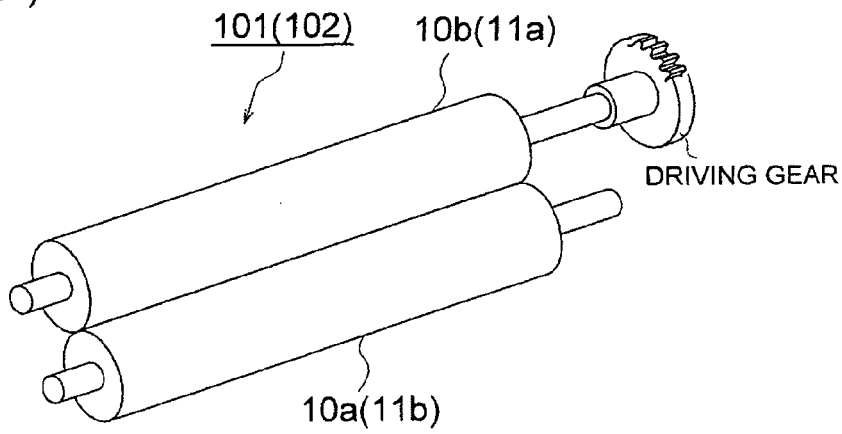
FIGS. 2A and 2B are diagrams showing rollers related to conveying a sheet in an intermediate sheet conveying device.
Figure 2:
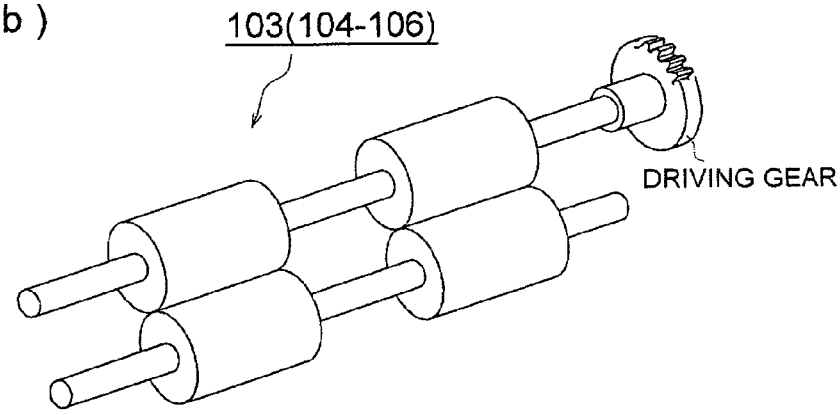

In the first conveying path 20, passing roller pairs 101 and 102 (Each roller of which is a single roller and long in the axial direction). Each roller has the same diameter throughout in the lateral direction of a sheet and uniformly contacts with a sheet. The rollers are driving rollers 10*b* and 11*a* made from EPC (ethylene-propylene copolymer) rubber and driven rollers 10*a* and 11*b* made from POM (polyoxymethylene) resin or EPC with a thermal conductivity in a range from 0.01 to 1.0 W/(m·K) so that a sheet is not quenched. The rollers press each other with a spring action, not shown, so that the rollers contact with a sheet uniformly (refer to FIG. 2A). Conveying roller pairs 103, 104, 105, and 106 are driving rollers that are made from EPC and disposed in a plural number in the axial direction, and conveying rollers being driven rollers that are made from POM (refer to FIG. 2B). The above described passing roller pairs 101 and 102 are powered by a driving unit, not shown, through a driving gear latched by the driving rollers 10*b* and 11*a* and thus rotate.

Each of the passing roller pairs 101 and 102 in the present embodiment has the same diameter throughout in the lateral direction (axial direction) of a sheet. However, even if the diameter is not the same throughout in the lateral direction (axial direction) of a sheet, by making the diameter be uniform, at least, in the region of the sheet passing width, the thermal capacity can be made uniform in the region of the sheet passing width and the pressure applied to the entire area of the sheet is made equal.

FIG. 1 shows the roller pairs related to sheet conveying in the intermediate sheet conveying device.

A cooling path 20*a* is arranged with a sheet conveying guides 20*b*, 20*c*, 20*d*, and 20*e* having a sheet passing surface in the same shape throughout the region of the sheet passing width and having no notch holes nor a sheet passing lib on the conveying surface. A cooling fan F supplies a cold air flow to a sheet having been delivered to the intermediate sheet conveying device B.

In such a manner, the surface temperature of a sheet is maintained equal to a predetermined temperature or lower (equal to the glass transition temperature of the toner or lower) in a predetermined section (the conveying path in the area T shown by a dashed curve) including the passing roller pairs 101 and 102 and the cooling path 20*a*, and thus uneven glossiness (roller trace) is prevented.

In the present embodiment, the distance from the sheet ejection rollers 10 to the passing roller pair 102 is approximately 200 mm, and the sheet linear speed (ejection sheet linear speed) in the image forming apparatus main body A is 150 mm/sec, 200 mm/sec, 300 mm/sec, or 667 mm/sec, depending on the amount of sheets. A sheet is delivered to the intermediate sheet conveying device B and the trailing edge of the sheet passes through the roller pair 102 at one of these speeds. Thereafter, the speed is accelerated to a linear speed of 1000 mm/sec that is the linear speed at which the post-processing device C receives a sheet, and the sheet is delivered from the conveying roller pair 106 to the entrance opening 201 at this speed.

That is, a sheet is not accelerated rapidly before the trailing edge of the sheet passes the above described predetermined section, and the sheet is conveyed at the same speed as in the image forming apparatus main body A. When the sheet has been cooled down to a predetermined temperature or lower in the predetermined section, no glossiness occurs thereafter even if the sheet is not cooled uniformly. After the trailing edge of the sheet passes the predetermined section, the linear speed of the conveying roller pairs 103, 104, 105, and 106, which are on the downstream side from the predetermined section, is accelerated to be higher than the speed in the image forming apparatus main body A, and the speed of the sheet becomes the same as the speed at the time of receiving the sheet by the post-processing device C, and thus the sheet is delivered to the post-processing device C.

Uneven glossiness can be prevented by passing a sheet through a predetermined section in a conveying path in accordance with the above described mechanism and structure.

What is claimed is:

1. An intermediate sheet conveying device disposed between an image forming apparatus main body and a post-processing device, that receives a sheet on which a toner image has been heat-fixed by a heat-fixing unit of an image forming apparatus main body, and delivers the sheet to a subsequent post-processing device, the device comprising:

a first pair of conveying rollers each of which is a single roller having the same diameter throughout a width for passing a sheet and is disposed at least in a predetermined section which is on a receiving side for receiving a sheet from the image forming apparatus main body;

a second pair of conveying rollers each of which is a single roller having the same diameter throughout the width for passing the sheet and is disposed at downstream of the first pair of conveying rollers in a sheet conveying direction within the predetermined section;

wherein the first and second pairs of conveying rollers being made of a material with a thermal conductivity in a range from 0.01 to 1.0 W/(m·K);

a sheet conveying guide provided between the first pair of conveying rollers and the second pair of conveying rollers and having a sheet-passing surface made in the same shape throughout the width for passing the sheet in the predetermined section, a sheet-passing surface of the same shape throughout the width for passing a sheet; and a cooling fan provided at upper side of the first pair of conveying rollers.

2. The intermediate sheet conveying device of claim 1, wherein the predetermined section extends to where a surface temperature of the sheet after heat-fixing is lowered to a glass transition temperature of toner or lower.

3. The intermediate sheet conveying device of claim 1, further comprising other conveying rollers on a downstream side, in a sheet conveying direction, of the second pair of conveying rollers, wherein, the intermediate sheet conveying device conveys a sheet at the same speed as a linear speed at which the image forming apparatus main body ejects the sheet, after receiving the sheet from the image forming apparatus main body until a trailing edge of the sheet passes the predetermined section, and thereafter conveys the sheet, switching a linear speed of the other conveying rollers to the same linear speed as a linear speed at which the post-processing device receives the sheet.

4. An image forming apparatus, comprising:

an image forming apparatus main body that forms an image on a sheet;

an intermediate sheet conveying device that receives a sheet on which a toner image has been heat-fixed by a heat-fixing unit of an image forming apparatus main body, and delivers the sheet to a subsequent post-processing device, the device comprising:

a first pair of conveying rollers each of which is a single roller having the same diameter throughout a width for passing a sheet and is disposed at least in a predetermined section which is on a receiving side for receiving a sheet from the image forming apparatus main body;

a second pair of conveying rollers each of which is a single roller having the same diameter throughout the width for passing the sheet and is dispersed at downstream of the first pair of conveying rollers in a sheet conveying direction within the predetermined section;

wherein the first and second pairs of conveying rollers being made of a material with a thermal conductivity in a range from 0.01 to 1.0 W/(m·k);

a sheet conveying guide provided between the first pair of conveying rollers and the second pair of conveying rollers and having a sheet-passing surface made in the same shape throughout the width for passing the sheet in the predetermined section, a sheet-passing surface of the same shape throughout the width for passing a sheet; and a cooling fan provided at upper side of the first pair of conveying rollers; and a post-processing device that receives a sheet from the intermediate sheet conveying device and performs post-processing on the sheet, wherein the predetermined section for the cooling process extends to where a surface temperature of the sheet after the heat-fixing process is lowered to a glass transition temperature of toner or lower.

* * * * *